US006507131B1

(12) United States Patent
Malfroy et al.

(10) Patent No.: US 6,507,131 B1
(45) Date of Patent: Jan. 14, 2003

(54) HIGH-VOLTAGE TRANSFORMER

(75) Inventors: Michel Malfroy, Vantoux (FR); Daniel Goudey, Gray (FR); Samuel Nguefeu, Antony (FR)

(73) Assignee: Thomson Licensing, S.A., Boulogne-Billancourt (FR)

( * ) Notice: Subject to any disclaimer, the term of this patent is extended or adjusted under 35 U.S.C. 154(b) by 0 days.

(21) Appl. No.: 09/542,900

(22) Filed: Apr. 4, 2000

(30) Foreign Application Priority Data

Apr. 8, 1999 (EP) ..... 99106932

(51) Int. Cl.[7] ..... H01H 27/42

(52) U.S. Cl. ..... 307/104; 336/198; 336/192; 336/208

(58) Field of Search ..... 336/198, 192, 336/208; 307/104

(56) References Cited

U.S. PATENT DOCUMENTS

| | | | | | |
|---|---|---|---|---|---|
| 4,091,349 | A | * | 5/1978 | Niederjohn et al. | 336/192 |
| 5,343,614 | A | * | 9/1994 | Betz et al. | 29/605 |
| 5,673,013 | A | * | 9/1997 | Moody et al. | 336/192 |
| 6,373,203 | B1 | * | 4/2002 | Goseberg et al. | 315/411 |

FOREIGN PATENT DOCUMENTS

| | | | | |
|---|---|---|---|---|
| DE | 3741556 | | 6/1988 | H01F/15/18 |
| DE | 3822284 | | 1/1990 | H01F/27/28 |
| GB | 2197544 | | 5/1988 | H01F/27/32 |
| WO | 99/03118 | | 1/1999 | H01F/38/42 |
| WO | WO99/03118 | * | 1/1999 | H01J/29/70 |

OTHER PUBLICATIONS

Copy of Search Report.

* cited by examiner

*Primary Examiner*—Stephen W. Jackson
*Assistant Examiner*—Robert L. DeBeradinis
(74) *Attorney, Agent, or Firm*—Joseph S. Tripoli; Joseph J. Laks; Daniel E. Sragow

(57) ABSTRACT

The high-voltage transformer comprises a core, a primary winding, a high-voltage winding arranged in a coil former, and a housing, whereat the primary winding is arranged at the outside of the housing. The housing is preferably cylindrical with wall-like juts between which the primary winding is wound, said juts especially placed at each side of the housing. The primary winding can be arranged as a dense winding at the outside of the housing which covers essentially the high voltage winding to shield the high voltage winding electrically. Auxiliary windings for providing low supply voltages can be placed also outside together with the primary winding. The transformer comprises only two plastic parts which requires less production steps and less material.

10 Claims, 2 Drawing Sheets

HIGH-VOLTAGE TRANSFORMER

TECHNICAL FIELD

The present invention relates to a high-voltage transformer having a core, a primary winding, a high-voltage winding being arranged in a coil former and a housing. Transformers of this kind are especially applicable in television sets and computer monitors.

BACKGROUND OF THE INVENTION

A widely used type of this high-voltage transformer is explained by means of FIGS. 1*a* to 1*c*: In FIG. 1*a* a first coil former 11 of the high-voltage transformer is shown having a cylindrical part which holds a primary winding W1 and a bottom part with terminals 10 which provide connections to a printed circuit board. Through an opening 9 of the coil former 11 a ferrite core K is fit, usually a U/U-core.

In FIG. 1*b* a coil former 13 is shown with chambers 4 in which the high-voltage winding WH is arranged. The high-voltage winding WH is separated by diodes D into partial windings to work as a diode-split high-voltage transformer. The number of diodes D depends on the required high-voltage value and the beam current for a certain picture tube, they can be placed above the high-voltage winding WH on walls separating the chambers 4 as well as separately in additional chambers. The high-voltage coil former 13 fits tightly over the cylindrical part with the coil former 11 of the primary winding W1.

Coil former 13 and coil former 11 are covered by a housing 12 shown in FIG. 1*c*. It is open at the bottom side facing the printed circuit board and comprises two holes 14 and 15 through which the ferrite core K is fit. It comprises further in this embodiment two chimney-like terminals 5 and 6 for the high-voltage cable and the focus cable.

In the international patent application WO 99/03118 a diode split high-voltage transformer is disclosed in which the primary winding is placed on top of the high-voltage winding, the high-voltage windings therefore lying between the primary winding and the core. At the end of the production the housing 12 is placed over the coil former of the high-voltage winding WH and the coil former 11 with the primary winding W1 and filled up with resin to avoid high-voltage sparking and corona effects inside of the high-voltage transformer.

SUMMARY OF THE INVENTION

This object is achieved by means of the invention as specified in claim 1. Advantageous developments of the invention are disclosed in the subclaims.

In the case of the high-voltage transformer of the invention the primary winding is not arranged inside of the housing but outside directly on the housing. Providing the housing with a cylindrical shape it is for example only necessary to arrange two wall-like extensions or juts at the housing between which the primary winding can be wound. The winding can be done automatically in the production as known before and can be arranged as a dense package.

In an advantageous embodiment the primary winding extends in its width completely over the chambers of the high-voltage winding to provide a good electrical shielding for the high-voltage transformer. Also, auxiliary windings for additional voltages which are usually provided by the high-voltage transformer can be placed outside of the housing above the primary winding. The housing can furthermore hold up the diodes being placed above the high-voltage winding and the terminals for the focus and the high-voltage cable as done by the former types.

The transformer comprises only two plastic parts which requires less production steps and less material. Because primary and auxiliary windings are placed outside the housing the volume of the housing is much reduced and therefore much less resin is required to fill up the high-voltage transformer. This leads to a considerable weight reduction. The voltage isolation of the primary and the auxiliary windings is no problem for the safety and the reliability of the high-voltage transformer because isolated wires are used. Only the high-voltage winding has to be isolated with resin.

BRIEF DESCRIPTION OF THE DRAWINGS

The invention is further explained by means of an embodiment shown in the following figures, which shows.

DESCRIPTION OF THE PREFERRED EMBODIMENTS

Figure 2B:
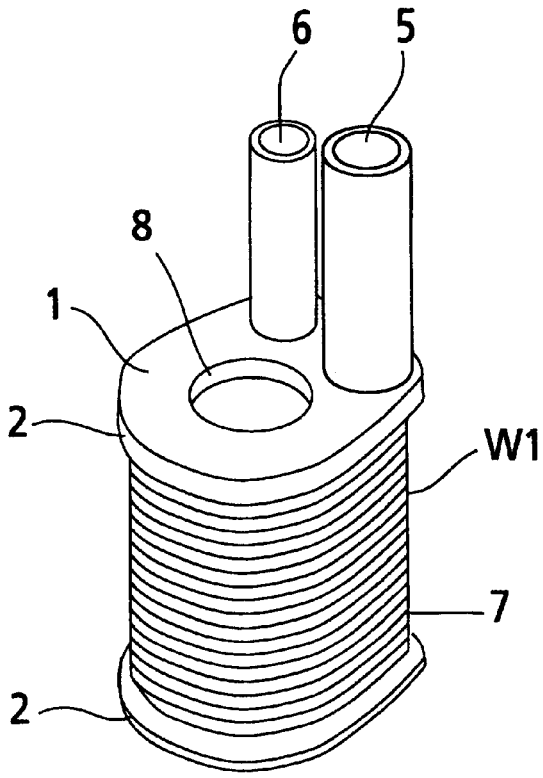
Figure 2A:
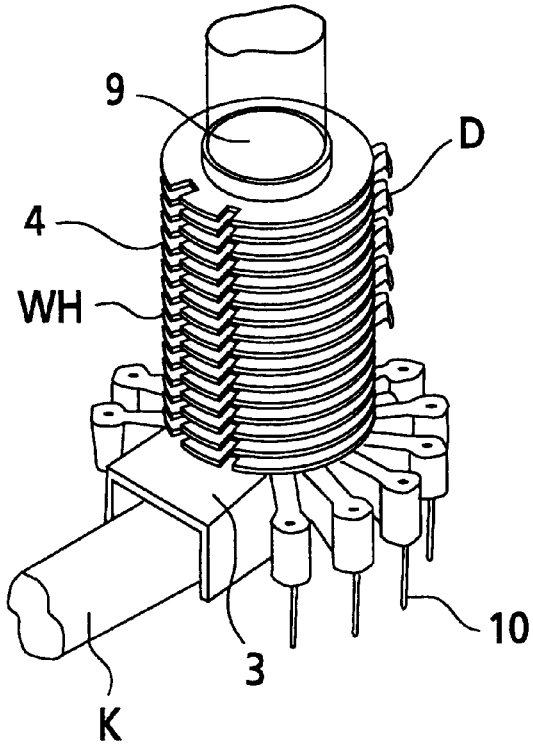

FIG. 2*a* illustrates a coil former of a high-voltage transformer in which a high-voltage winding WH is arranged. The windings are placed in chambers 4 being connected together directly or by diodes D resulting in partial windings as known from the diode-split principle. The coil former 3 comprises further terminals to which the windings are connected and which provide the connections to a circuit when the high-voltage transformer is mounted on a printed circuit board. It comprises further an opening 9 through which a ferrite core K (shown only schematically)is fed through.

In FIG. 2*b* a housing 1 is shown which can be placed directly over the high-voltage winding WH of FIG. 2*a*. It is of cylindrical shape, therefore a primary winding W1 can be wound directly onto the housing 1 at the outside. To provide a defined dense winding the housing 1 comprises wall-like extensions or juts 2 between which the primary winding W1 is wound. The juts 2 can be advantageously placed at the lower side and the upper side of the housing 1 so that the primary winding W1 shields the high-voltage winding WH completely when the housing 1 is mounted together with the coil former 3 in the production. In addition, further auxiliary windings, not shown in FIG. 2*b*, can be placed above the primary winding W1.

During the production the housing 1 is mounted above the high-voltage winding when the high-voltage winding WH is finished and then filled up with resin. Then the primary and auxiliary windings are placed on the housing 1 and connected to the terminals 10 in next steps. Filling the transformer with resin can be performed as known before, the housing 1 closes tightly with the coil former 3 at the upper side 8 of the high-voltage transformer so that the resin can be filled up from the lower side being open, after the housing 1 is put over the coil former 3.

In another solution the housing 1 is mounted above the high-voltage winding WH when the high-voltage winding is finished and then the primary and the auxiliary windings are placed on the housing 1 and connected to the terminals 10. Then the transformer is filled up with resin.

For the primary winding W1 and the auxiliary windings especially wires of the same thickness, for example with a diameter of about 0.4 to 0.5 mm with isolation can be used, the wires having a voltage resistivity of about 3000 V.

Figure 1C:
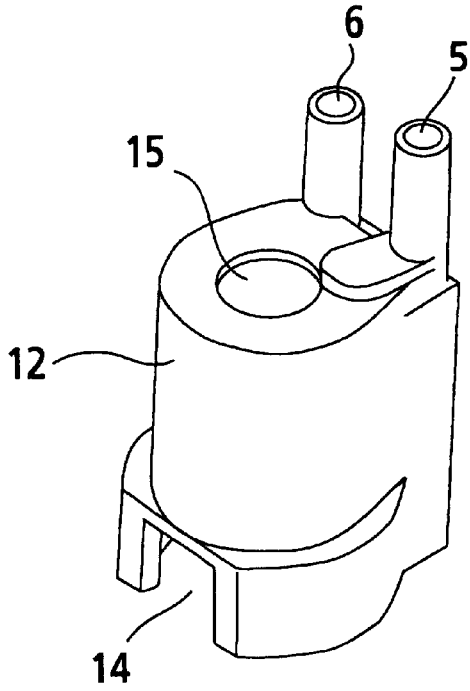
FIG. 1*a*-1*c*: a high voltage transformer according to prior art as already described, FIG. 2*a* a coil former with a high-voltage winding, and FIG. 2*b* the housing with a primary winding.
Figure 1B:
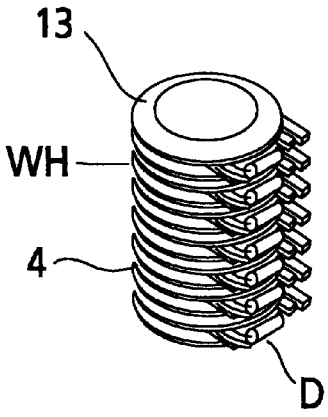
Figure 1A:
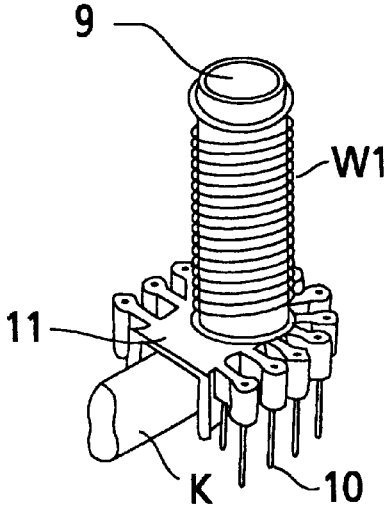

In FIG. 1 and FIG. 2 same reference numbers are used when elements are identical. The invention is not restricted to the special embodiment of the FIGS. 2*a* and 2*b* showing a high-voltage winding which is arranged in chambers 4. It can be used also for high-voltage transformers with layer technology, in which the high-voltage winding is arranged as layers within a coil former. Furthermore, although diode-split high-voltage transformers are widely used for television sets and computer monitors it is also possible to use the invention for other types of high-voltage transformers.

What is claimed is:

1. Diode split high-voltage transformer for voltages of 15 kV up to 35 kV, comprising a primary winding, a high-voltage winding, a core, and a housing, said high-voltage winding being arranged on a coil former inside said housing, said housing being moulded with a resin, and said primary Riding being arranged at the outside of said housing.

2. High-voltage transformer according to claim 1, characterized in that said housing is cylindrical with wall-like juts, between which said primary winding is wound, said juts placed at each side of said housing.

3. High-voltage transformer according to claim 2, characterized in that said primary winding is arranged as a dense winding which covers essentially said high voltage winding to shield said high voltage winding electrically.

4. High-voltage transformer according to claim 3, characterized in that auxiliary windings are placed above said primary winding.

5. High-voltage transformer according to claim 2, characterized in that said high voltage winding is arranged in chambers of said coil former, that diodes are arranged in tangential direction above said high voltage winding and that said housing has an oval extension at one side to take up the diodes.

6. High-voltage transformer according to claim 5, characterized in that the feedthroughs for the high voltage cable and the focus cable are also arranged in said extension.

7. High-voltage transformer according to claim 1, characterized in that said housing closes tightly with said coil former at the upper side of said high voltage transformer and that said high voltage transformer contains an opening at the lower side for filling said transformer with said resin.

8. High-voltage transformer according to claim 1, characterized in that the wire of said primary winding has a voltage resistivity of about 3000 V.

9. High-voltage transformer according to claim 1, characterized in that said high-voltage transformer is for use in television sets and monitors.

10. High-voltage transformer for voltages of 15 kV up to 35 kV, comprising a primary winding, a high-voltage winding, a core, a housing, and a coil former with an inner cavity, in which said core is fed through, said high-voltage winding being arranged on said coil former inside said housing, and said housing with said high-voltage winding being moulded with a resin, the surface of said inner cavity being provided with a conductive coating, and said primary winding being arranged at the outside of said housing.

* * * * *

UNITED STATES PATENT AND TRADEMARK OFFICE

CERTIFICATE OF CORRECTION

PATENT NO. : 6,507,131 B1
APPLICATION NO. : 09/542900
DATED : January 14, 2003
INVENTOR(S) : Michael Malfroy, Daniel Goudey and Samuel Nguefeu It is certified that error appears in the above-identified patent and that said Letters Patent is hereby corrected as shown below:

Title Page #56
On page 1, under the Foreign Patent Documents, "WO 99/03118" (first occurrence) should read --WO 99/93117--.

Signed and Sealed this

Seventh Day of November, 2006

JON W. DUDAS
*Director of the United States Patent and Trademark Office*